United States Patent [19]

Jolly

[11] Patent Number: 4,949,964

[45] Date of Patent: Aug. 21, 1990

[54] EXTENDABLE CUE STICK

[76] Inventor: James D. Jolly, Rte. 2, Box 84, Glen Dean, Ky. 40141

[21] Appl. No.: 338,185

[22] Filed: Apr. 14, 1989

[51] Int. Cl.[5] ..... A63D 15/08

[52] U.S. Cl. ..... 273/68; 403/104; 403/109

[58] Field of Search ..... 273/68, 80 D, 81.2, 273/2, 69; 403/104, 109, 118; 248/188.5

[56] References Cited

U.S. PATENT DOCUMENTS

| | | | |
|---|---|---|---|
| 861,158 | 7/1907 | Bucknum | 273/68 |
| 1,175,256 | 3/1916 | Graver | 403/104 |
| 1,185,732 | 6/1916 | Swayne | 403/109 |
| 1,406,891 | 2/1922 | Foss | 403/109 |
| 3,740,034 | 6/1973 | Scroggins | 273/68 |
| 4,718,671 | 1/1988 | Desmond et al. | 273/68 |

FOREIGN PATENT DOCUMENTS

| | | | |
|---|---|---|---|
| 286197 | 10/1988 | European Pat. Off. | 273/68 |
| 2489162 | 3/1982 | France | 273/68 |
| 2174611 | 11/1986 | United Kingdom | 273/68 |

*Primary Examiner*—Edward M. Coven
*Assistant Examiner*—Mark S. Graham
*Attorney, Agent, or Firm*—Kalish & Gilster

[57] ABSTRACT

A cue stick is provided with an extension assembly inserted into the handle end of the stick. The extension assembly includes a tube having internally threaded end portions. A shaft having a threaded locking end is inserted into the tube and threadably engages a first threaded tube end. Rotating the handle end of the cue stick in a counter-clockwise direction disengages the tube first end from the shaft and enables extension of the handle. Again, rotating the handle in a counter-clockwise direction causes the shaft to threadably engage a second threaded tube end thus locking the cue stick in an extended length.

4 Claims, 1 Drawing Sheet

FIG. 1
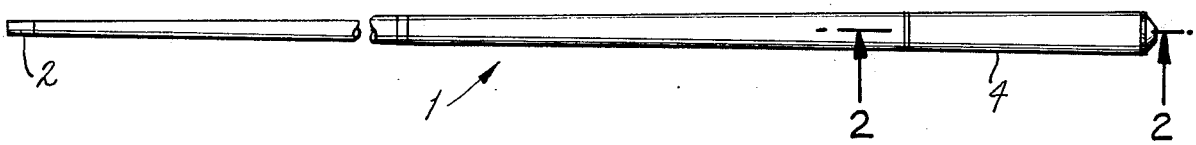
FIG. 2
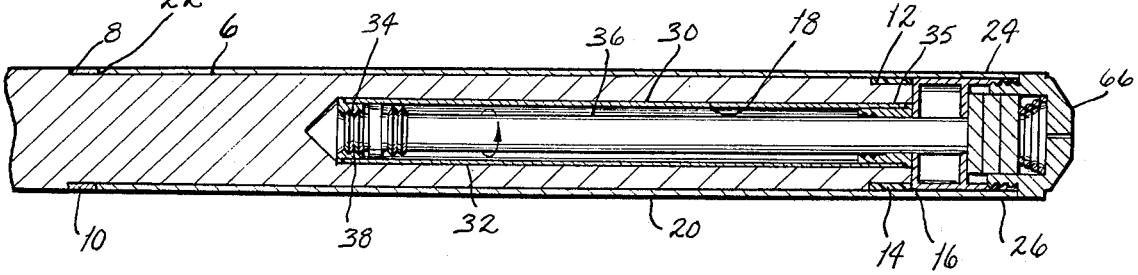
FIG. 3
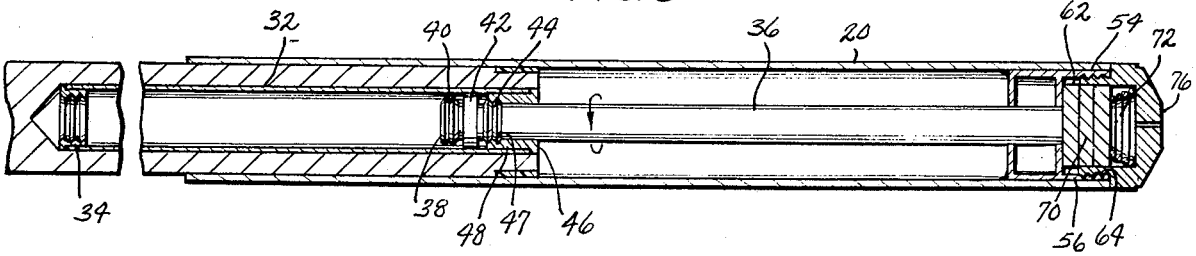
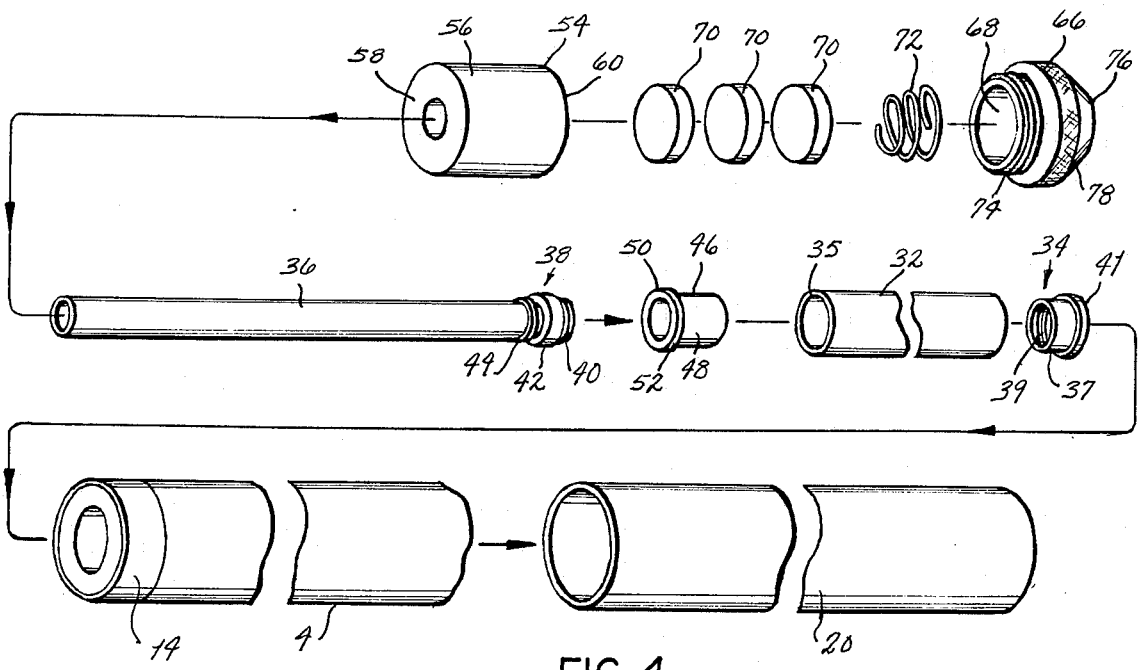
FIG. 4

EXTENDABLE CUE STICK

BACKGROUND OF THE INVENTION

1. Field of the Invention

The present invention generally relates to cue sticks as typically used in playing pool and billiards, and more particularly, to cue sticks that contain a built-in extendable handle so that the length of the stick can be extended.

2. Brief Description of the Prior Art

The games of billiards and pool are ones that are enjoyed and played by countless millions. Anyone that has played either of these games has experienced at one time or another difficulty lining up and taking a shot when the cue stick was not quite long enough for proper positioning of the game balls and the player. Typically, in instantaneous such as this the player would usually use a bridge. Although using a bride enables a player to make an otherwise awkward and difficult shot, this device has not proved to be entirely satisfactory. The most accurate shots can be achieved when a player is able to use both hands on a cue stick. When a player is forced to use a bridge, only one hand can be used on the cue stick while the other hand must hold and support the bridge. There is therefore a need for a cue stick that can be readily extended to various lengths, thus enabling a player to use both hands on the stick while making shots. A cue stick containing this feature would enable a player to achieve a higher score and improve his enjoyment of the game.

SUMMARY OF THE INVENTION

The present invention is a cue stick that contains a built-in extension assembly. The extendable cue stick of this invention thus enables a player to forego the use of a bridge when making shots that otherwise would require the use of this device. A cue stick is provided with a handle end having a reduced outside diameter and containing an internal bore. An elongated external hollow sleeve member is placed over the handle end. An extension assembly is inserted into the handle end bore and positioned within the end of the hollow sleeve member. The extension assembly includes a tube having an internally threaded end and a shaft having a threading locking end. The shaft is adapted to threadaly engage the threaded tube end. An internally threaded sleeve is positioned on the shaft and is further adapted to threadably engage a second threaded portion of the locking end and also be retained within the tube. A cylindrical cap member is fastened to the shaft and adapted to be inserted into the external hollow sleeve. When the shaft is rotated by a player the locking end threadably engages the tube end on the internally threaded sleeve causing the shaft to move within the tube thus extending the length of cue stick.

Accordingly, it is an object of the present invention to provide an extendable cue stick.

It is a further object of this invention to provide a cue stick that contains an internally disposed, extension assembly that enables the length of a cue stick to be varied.

It is a still further object of this invention to provide an extendable cue stick that has a handle end with a built-in extension assembly having a weighted, detachable cylindrical cap.

BRIEF DESCRIPTION OF THE DRAWINGS

FIG. 1 is a plan view of a cue stick that contains a built-in extension assembly of the present invention contained within the handle end.

FIG. 2 is an enlarged sectional view taken through lines 2—2 showing the extension assembly of the present invention in a retracted position.

FIG. 3 is an enlarged sectional view taken through lines 2—2 showing the extension assembly of the present invention in an extended position.

FIG. 4 is an exploded partially perspective view of the extension assembly of the present invention.

DETAILED DESCRIPTION OF THE PREFERRED EMBODIMENT

Referring now to the drawings, and more particularly to FIG. 1, there is shown a cue stick containing an extension assembly of the present invention. Reference Numeral 1 designates a cue stick for use in playing pool or billiards which includes a tip end 2 and a gripping or handle end 4 that is generally held by a player while playing the game. As more clearly shown in FIG. 2, handle end 4 is provided with a first reduced outside diameter section 6, having a shoulder 8 which includes annular ring 10 that may be manufactured of brass or copper for decorative purposes. Handle end 4 is also provided with second reduced diameter section 12 which includes plastic ring 14 having rounded outer edge 16. Handle end 4 contains internal bore 18 centrally located within reduced section 6. Positioned in coaxial alignment on section 6 is external elongated hollow sleeve member 20, that may be typically manufactured from stainless steel or aluminum tubing. These materials have proven to be most satisfactory because of their inherent rust and corrosion resistance thereby providing a metallic cue stick handle that will resist such surface deterioration which may result from perspiration on a player's hands or atmospheric moisture. First end 22 abuts ring member 10 and second end 24 of hollow sleeve member 20 projects a distance 26 beyond reduced diameter section 6 of the cue stick.

As illustrated in FIGS. 2 and 3, an extension assembly 30 is inserted into internal bore 18 and second end 24 of elongated sleeve member 20 thus insuring that it will be retained in a manner to be extended as hereinafter more fully discussed. To facilitate operation of extension assembly 30, this assembly is bonded or glued with an epoxy compound or a similar type of bonding agent to internal bore 18 and hollow sleeve member second end 24.

Extension assembly 30 includes tube 32 that is provided with internally threaded first end 34 and internally smooth second end 35 and centrally positioned shaft 36. As shown in more detail in FIG. 4, threaded first end 34 includes sleeve 37 that is substantially the same diameter as the internal diameter of tube 32, internal threaded section 39 and shoulder portion 41 for retaining sleeve 37 within tube 32. Shaft 36 includes plug end portion 38 having first threaded portion 40, adjacent thereto is sleeve or bushing section 42 that is substantially the same diameter as the internal diameter of tube 32 and second threaded portion 44. First threaded portion 40 is adapted to threadably engage internally threaded first end 34 of tube 32. A sleeve member 46 having an internally threaded portion 47, a body portion 48 with a diameter essentially equal to the inside diameter of tube 32 and upper portion 50 consisting of retaining shoulder 52 is located on shaft 36. Sleeve 46 is adapted to be inserted into internally smooth second end 35 of tube 32 with the retaining shoulder 52 positioned on the end of the tube 32. As will be discussed in more detail, second threaded portion 44 of shaft 36 is adapted to threadably engage internally threaded sleeve 46. Fastened to the end of shaft 36 is cylindrical cap member 54. The construction of this member can be more readily understood by reference to the exploded view shown in FIG. 4. This figure shows that cap member 54 includes body portion 56 having a diameter that is essentially equal to the inside diameter of elongated hollow sleeve member 20. Thus cap member 54 can be readily inserted into hollow sleeve member 20 and fastened thereto in any conventional manner such as bonding with an epoxy glue. Cylindrical cap member 54 further includes flat first end 58 and detachable end 60. Cap member 54 also contains a hollow interior chamber 62 having internally threaded upper portion 64. A detachable cap end 66 completes extension assembly 30. Cap end 66 includes hollow center portion 68 that contains a series of weighted members 70, held in position by helical spring 72 located in the rear most portion of hollow center 68. End cap 66 is further provided with an externally threaded shoulder 74 adapted to be threadably engaged with corresponding internally threaded cap member upper portion 64 and a concave barrel head 76 having knurled outer surface 78.

OPERATION OF THE INVENTION

The extendable cue stick of this invention is operated in the following manner:

In order to extend cue stick 1 beyond its normal length, a player grips and rotates elongated hollow sleeve member 20 in a counter-clockwise direction. This movement causes first threaded portion 40 of shaft 36 to be threadably disengaged from internally threaded first end 34 of tube 32. After these two threaded elements are disengaged, the player then moves hollow sleeve member 20 rearwardly until second threaded portion 44 of shaft 36 contacts internally threaded sleeve 46. Hollow sleeve member 20 is again rotated in a counter-clockwise direction, thus threadably engaging second threaded portion 44 with internally threaded portion 47 of sleeve 46. Upon engaging these two threaded sections, the cue stick is extended the distance of tube 32 and also locked into position by rotating hollow sleeve member 20 counter-clockwise so that it will not collapse when a player uses it. After a shot is made or if the player desires to return the cue stick to its normal length, hollow sleeve member 20 is rotated in a clockwise manner, thus disengaging second threaded portion 44 from internally threaded sleeve portion 47. Elongated hollow sleeve member 20 is thus moved toward ring 10 until these two members abut each other. Hollow sleeve member 20 is rotated in a clockwise direction, thus once again engaging first threaded portion 40 of shaft 36 with internal threaded first end 34 of tube 32.

I claim:

1. An extendable cue stick, comprising:

a first shaft having an end with a reduced outside diameter and containing an internal bore;

an elongated external hollow sleeve member adapted for co-extensive alignment with said reduced outside diameter shaft end and extending beyond the end of said reduced outside diameter shaft end; and an extension assembly inserted into said shaft bore wherein said extension assembly further comprises:

a tube having an internally threaded first end and an internally smooth second end;

a second shaft having a threaded locking end comprising a first threaded portion, an annular sleeve portion adjacent thereto and a second threaded portion, wherein said first threaded portion is adapted to threadably engage said tube threaded end;

an internally threaded sleeve member having a retaining shoulder positioned on said tube and adapted to threadably engage said second threaded portion of said locking end, and said internally threaded sleeve member being retained within said tube second end; and a cylindrical cap member means fastened to said second shaft and inserted into said external hollow sleeve member for causing said second shaft to be rotated and moved within said tube.

2. The cue stick of claim 1 wherein said cylindrical cap member means further comprises an internal cavity, an internally threaded end and an end cap having an externally threaded portion means for threadable engagement with said internal cavity.

3. The cue stick of claim 2 wherein said cylindrical cap member means contains weights in said internal cavity.

4. The cue stick of claim 3, wherein said end cap contains a helical spring means for retaining said weights in said cavity.

* * * * *